United States Patent [19]

Nolan

[11] 4,192,126

[45] Mar. 11, 1980

[54] COILING MACHINE

[75] Inventor: John P. S. Nolan, Northwood, England

[73] Assignee: Skemmill Limited, London, England

[21] Appl. No.: 927,148

[22] Filed: Jul. 24, 1978

[51] Int. Cl.[2] ..... B65H 81/08

[52] U.S. Cl. ..... 57/3

[58] Field of Search ..... 57/7, 6, 9, 13, 14, 57/16–18, 58.3, 58.36, 58.38

[56] References Cited

U.S. PATENT DOCUMENTS

| | | | |
|---|---|---|---|
| 443,491 | 12/1890 | Ball | 57/58.30 X |
| 2,258,139 | 10/1941 | Johnston, Jr. | 57/3 X |
| 2,463,689 | 3/1949 | Greenwood | 57/3 |
| 2,882,673 | 4/1959 | Buddecke | 57/3 X |
| 2,993,332 | 7/1961 | Hughes | 57/3 |
| 3,732,679 | 5/1973 | Sohr | 57/18 X |
| 4,041,683 | 8/1977 | Heimlicher | 57/18 |

FOREIGN PATENT DOCUMENTS 1011699 12/1965 United Kingdom .

*Primary Examiner*—John Petrakes

*Attorney, Agent, or Firm*—Paul Fields

[57] ABSTRACT

A machine is provided for coiling wire about a core filament, particularly for producing heat exchanger coils. The machine comprises a main frame, two coiling elements spaced from each other and mounted in the frame for rotation about substantially the same axis, a hollow mandrel on which the wire is to be coiled, the longitudinal axis of the mandrel substantially coinciding with said axis, and a wire guide on each of the coiling elements spaced from the said axis whereby a loop of wire may be formed with its ends substantially on the said axis and the remainder thereof spaced from the said axis. The machine further comprises means for rotating the two coiling elements in a substantially synchronous fashion so that wire guided about the elements is coiled on to the mandrel, means for preventing the mandrel from rotating relative to the frame, and means for feeding a core filament through the hollow mandrel. The mandrel carries a plurality of pins around which coils of wire are formed, the mandrel having a tapering portion up which a coil in the process of being formed sides and thereby pushes off from the pins a previously formed coil.

11 Claims, 6 Drawing Figures

Fig. 4a.
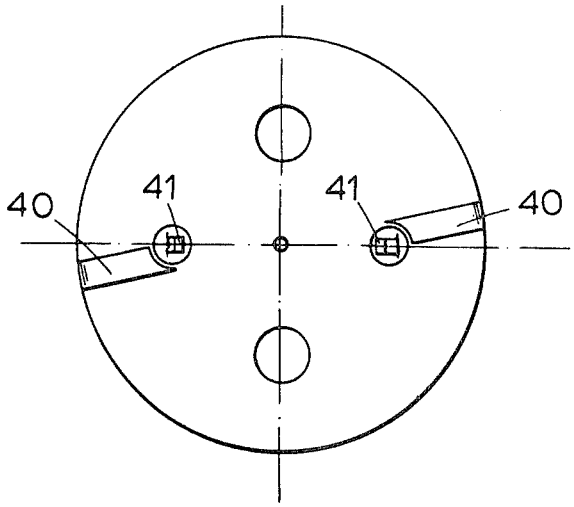
Fig. 4b.
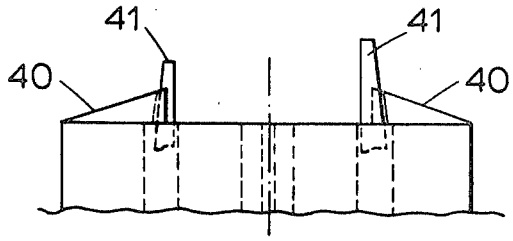
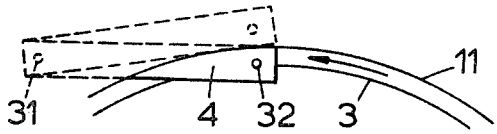
Fig. 2.
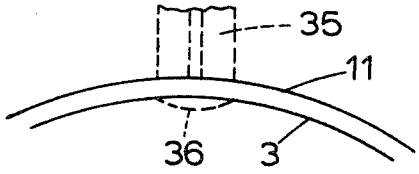
Fig. 3.

COILING MACHINE

FIELD OF THE INVENTION

This invention relates to a coiling machine and, in particular, to a machine for making helical coils of wire. The machine of the invention is adapted so that the helical coil can enclose one or more filaments and more particularly the machine can be used for the manufacture of a heat exchange tube in which the helical coils are themselves wound round a tube and the enclosed filament or filaments are of materials for bonding and/or binding the coils to the tube.

SUMMARY OF THE INVENTION

According to the invention, there is provided a machine for coiling wire about a core filament comprising a main frame, two coiling elements spaced from each other and mounted in the frame for rotation about substantially the same axis, a hollow mandrel on which the wire is to be coiled, the longitudinal axis of the mandrel substantially coinciding with said axis, a wire guide on each of the coiling elements spaced from the said axis whereby a loop of wire may be formed with its ends substantially on the said axis and the remainder thereof spaced from the said axis, means for rotating the two coiling elements in a substantially synchronous fashion so that wire guided about the elements is coiled on to the mandrel, means for preventing the mandrel from rotation relative to the frame, and means for feeding a core filament through the hollow mandrel, wherein the mandrel carries a plurality of pins around which coils of wire are formed, the mandrel having a tapering portion up which a coil in the process of being formed rides and thereby pushes off from the pins a previously formed coil.

By the term "in a substantially synchronous fashion", it is meant that the two coiling elements have the same mean rotational speed, when averaged over a number of revolutions of the elements. In other words, as the coiling elements are rotated, opposed points on the elements must not become out of phase by more than a few degrees. The precise amount of out-of-phase relationship which is allowable depends on the particular construction of the machine.

In a preferred embodiment, the mandrel forms part of a mandrel assembly which extends along the said axis and which is freely and rotatably mounted between the two coiling elements. A spool or spools for supplying a central filament or filaments may be mounted on the mandrel assembly between the two coiling elements. In this case, the loop of wire, at it rotates, passes round the filament spool or spools and depending on the spacing of the wire guides from the axis, and the axial spacing of the two coiling elements, relatively large filament spool or spools can be accommodated.

Means may also be provided for shaping the helical coils and, preferably, means are provided for keeping the tensions of the filament or filaments within predetermined limits.

The two coiling elements may be arranged for synchronous rotation in any of several ways. For example, they may be driven by two synchronous electric motors; or they may be driven from a single motor with the coiling elements either linked by means of a connecting member, in which case only one of the elements need be directly driven, or they may both be driven by means of a common lay shaft.

Where the mandrel assembly is freely mounted between the two coiling elements, it is clear that for coiling to take place, the mandrel assembly must be held stationary while the two coiling elements rotate around it. The means holding the mandrel stationary in this way must nevertheless allow passage of the loop of wire continuously around the assembly.

Various types of holding means are envisaged for this purpose. Thus, the holding means may be of a positive nature, for example a swashing gear (a gear which is toothed over only part of its circumference) acting between part of the mandrel assembly and the main frame; a gear and pulley system; or a mechanical latch acting between the mandrel assembly and the main frame. Alternatively, the mandrel assembly may be held substantially stationary by a non-positive holding means, for example by magnetic means, means for causing a fluid dynamic force to act between the main frame and the mandrel assembly, or simply by weighing the mandrel assembly in the fashion of a pendulum, so that the rotational force imparted to the mandrel assembly by the coiling elements rotating around it is sufficient only to displace the pendulum by a limited amount.

More than one wire can be coiled round the mandrel, means being provided so that the wires to be coiled can, if desired, be twisted about one another. Where the machine is used for the production of heat exchangers or elements used in heat exchangers, a tube or rod of suitable material and which may be of circular or non-circular cross-section is provided, together with means for bonding a binding filament and/or the said helical coils to the said tube or rod. The tube may be rotated about its axis and fed axially so that the core filament and the said wire are wound in a helix on the tube or rod at any desired speed. Provision may also be made to allow for the variations in winding-on speed associated with non-circular tubes or rods, and to drive the filament coiling means and the tube or rod at such relative speeds that any desired orientation of the said helical coils on the tube or rod may be obtained.

There are advantages in providing a device in which the mountings and/or spindle axes etc. of the said spools etc. can be kept stationary or substantially stationary, for the spools generally can be larger and heavier, rather than mass being the limiting factor on certain spools. The larger spools will require recharging or changing less often, thus saving time and money. Furthermore the machine speeds can be increased over those machines in which the masses of spools and of filaments wound on them, rotating at speed and eccentrically, cause vibration problems. Again this reduction in the rotational intertia of the machine enables starting and stopping to be carried out more rapidly with improved speed, safety and programming possibilities.

In some such machines there still exist disadvantages of complexity of construction, considerable rotating mass associated with certain filament guides or lack of provision for filaments to be enclosed by the helical coils. With the present invention, these disadvantages may be substantially reduced.

The core filament, may be carried on the machine on a spool and the wire for coiling is carried in a loop round the said spool; a bonding filament, where it is present and is required to be enclosed by the coils is also carried on a spool in a fashion similar to that for the core filament. In such a design, the sizes of the spools for the bonding and/or core filaments are limited by the maximum size of envelope traced out by the rotating loop of the coiling wire. However, this is less of a restriction on machine capacity than if such limits were applied to the coiling wire spool for, in a typical case, the coiling wire although of similar cross-section to the core filament, may be about thirty-five times its length. In practice, the limitations on the size of the coiling wire spool will probably result from considerations of handling and supply.

BRIEF DESCRIPTION OF THE DRAWINGS

FIG. 2 is an enlarged view of one type of holding means taken along line A—A of FIG. 1, FIG. 3 is an enlarged view of another type of holding means for the machine of FIG. 1, FIG. 4*a* and FIG. 4*b* are views of a mandrel head for use in the invention.

DESCRIPTION OF A PREFERRED EMBODIMENT

Figure 1:
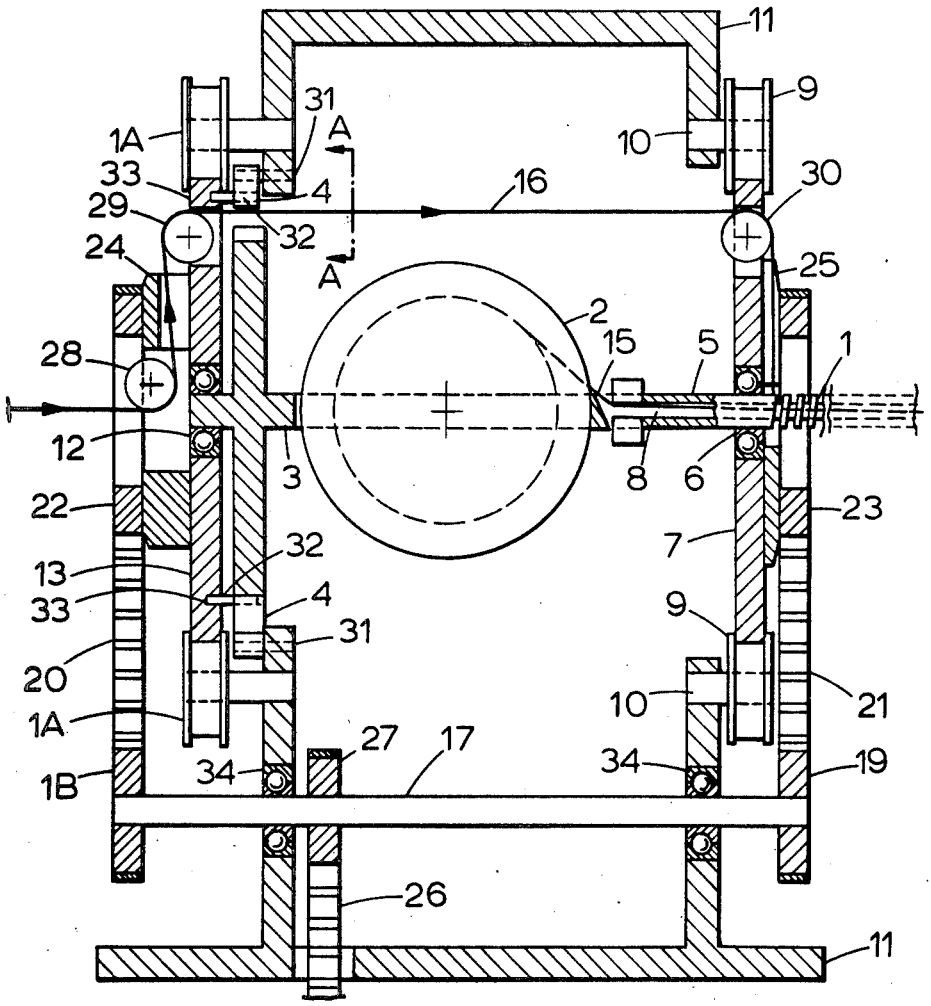
FIG. 1 is a schematic, sectional view of an embodiment of coiling machine.

In FIG. 1, a mandrel 1 and a core filament spool 2 are both carried on a central member 3 which is held substantially stationary with respect to the coiling parts of the machine by holding means including latches 4. A forepart 5 of the member 3 passes through a bearing 6 mounted coaxially in a circular foreplate 7. The forepart 5 carries a duct 8 for a flat cross-section core filament 15 and also provides a mounting for the mandrel 1. The mandrel 1 may also carry a continuation of the duct 8 or a groove or other means whereby a coiling wire or filament 16 in being coiled around mandrel 1 encloses the core filament 15.

The foreplate 7 is carried by three bearing assemblies 9 which are in turn carried on spindles 10 fixed in a housing 11. A rear part of the member 3 is located in a bearing 12 mounted coaxially in a rearplate 13 which is carried by bearing assemblies 1A in a manner similar to that by which the foreplate 7 is carried. The foreplate 7 and the rearplate 13 are arranged to rotate about substantially the same axis and are driven at the same angular velocity by a layshaft 17 mounted in bearings 34 located in the housing 11. The drive from the layshaft 17 to the rearplate 13 is taken via a toothed pulley 1B fixed to the layshaft, a toothed belt 20 meshing with the pulley 1B and another toothed pulley 22 fixed to the rearplate 13 via a spacer 24. The drive from the layshaft 17 to the foreplate 7 is taken via a toothed pulley 19 fixed to the layshaft, a toothed belt 21 meshing with the pulley 19 and a toothed pulley 23 fixed to the foreplate 7 via a spacer 25. A toothed belt 26 is driven by suitable means, not shown, and in turn drives a toothed pulley 27 fixed to the layshaft 17.

The coiling filament 16 passes from a spool, not shown, via suitable tensioning and other control devices of known design (not shown) and runs on to a guide pulley 28 which is mounted on the spacer 24. The said control devices are so positioned that the coiling filament 16 approaches the guide pulley 28 approximately coaxial to the rearplate 13. The coiling filament 16 passes round the guide pulley 28 and outwards between the rearplate 13 and the pulley 22 to a second guide pulley 29 mounted on the rearplate 13 and thence to a third guide pulley 30 mounted on the foreplate 7 and inwards between the foreplate 7 and the pulley 23 to the mandrel 1.

It will be seen that in this embodiment considerable saving in weight and increased simplicity in construction is achieved by eliminating the need for a guide for the coiling filament 16 as it passes between the second and third guide pulleys 29 and 30 across the spool 2. In some cases it will be advantageous to have a guard ring (not shown) passing round the spool 2 to prevent the filament 16 catching in the spool 2 for any reason; such a guard ring may also be rotatably mounted on the member 3 and increases in the size of the spool 2 may also be achieved by causing the filament 16 to deflect outwards by contact with the guard ring.

The latches 4 pivot about pins 31 locating in one end of the latches and fixed in the housing 11. The other end of each latch carries a pin 32 fixed in the latch and slidably located in a groove 33 carried in or on the rearplate 13, the groove 33 being eccentric with respect to axis of rotation of the rearplate 13. The coiling filament 16 is free to pass between the member 3 and the housing 11 since the eccentric groove 33 is arranged to lift the latch 4 clear of the member 3 via the pin 32 when the filament 16 passes. The central member 3 is prevented from rotating by a sufficiency of latches 4 engaging the member 3. In a preferred design, the latches will only prevent rotation of the member 3 in the direction of the torque applied to the member 3 by the filament 16 as it is coiled on to the mandrel 1. This design has certain advantages of simplicity and robustness.

FIG. 2 indicates how such a latch mechanism works, not all features being shown. One latch is shown in two positions; lowered to prevent rotation of the member 3 and raised to allow passage of the filament 16. The arrow indicates the direction of motion of the filament 16 in a particular embodiment. This has been chosen so that the torque due to coiling tends to hold the member 3 against the latches 4.

In such a design, since the member 3 can become displaced away from the latches if the tension in the filament 16 is not sufficient, a biassing torque should be provided and this can be done conveniently by weighting the member 3 eccentrically so that it tends to turn in the same direction as coiling. The latches 4 can have other configurations and be operated by any known means.

Furthermore, the holding means preventing rotation of the member 3 and associated parts can have other forms which include magnetic, fluid dynamic, e.g. aerodynamic, or other forces acting across an airgap between the housing 11 and the member 3 and through which airgap the filament 16 passes.

In a magnetic (or electromagnetic) device known means may be used to generate the necessary magnetic forces to hold the member 3 in non-rotating relationship with the housing 11.

Figure 5:
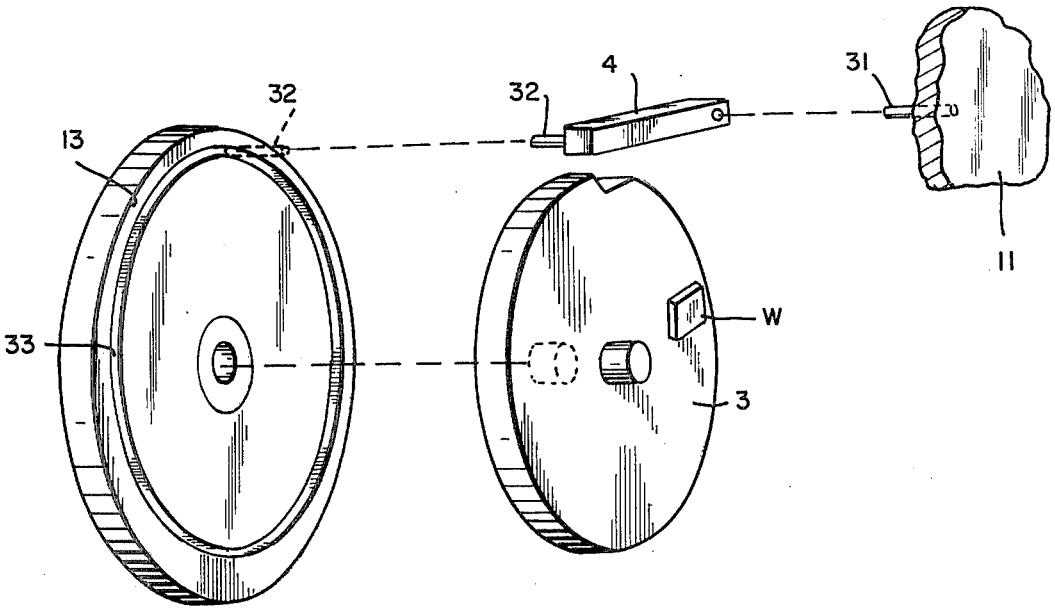
FIG. 5 is an exploded perspective view of the left-hand portion of FIG. 1.

Referring to FIG. 5, during coiling, the plate 13 rotates while the member 3 is held stationary by the latches 4, only one of which is shown in FIG. 5. Each latch 4 is pivotally mounted by a pin 31 secured at one end to the stationary housing 11, the other end being connected rotatably to the first end of latch 4; the second end of latch 4 carries a second pin 32. The second pin 32 is engaged in a groove 33 eccentrically formed (with respect to the axis) in the face of plate 13.

As the plate 13 rotates, the pin 32, being engaged in the notch 33, causes pivotal movement of the latch 4. During most of the period of operation, each latch 4 is engaged in a notch formed in the circumference of member 3. Each latch 4 disengages from the notch in member 3, when the plate 13 rotates to the position in which the respective pin 32 is in its radially outermost position; a small gap is left between the latch 4 and the member 3. The pulley 29 is mounted on the plate 13 so that the filament 16 is synchronised to pass through the gap between the latch 4 and member 3, when the latch 4 is raised (see FIG. 1). The member 3 continues to be held stationary during the coiling by the other latch 4.

The weight W is attached to the member 3 to bias the member 3 in a clockwise direction, thus keeping a notch in the outer portion of the member biased in engagement with one of the latches 4 at all times.

FIG. 3 shows, schematically, a design for a fluid dynamic device, in which 35 is a head of suitable dimensions, fixed to the housing 11 and carrying a duct with fluid at pressure. A groove 36 of suitable shape is provided in the member 3, such that, when the gap between the housing 11 and the member 3 is sufficiently small, but still allowing passage of filament 16, when the member 3 is rotated relative to the head 35, the pressure in the groove 36 changes to produce a restoring torque.

In any of the holding means where there is a limiting torque due to the design it will be necessary to fit a device to indicate rotation or incipient rotation and/or to stop the machine in the event of the same.

Positively acting means may be provided acting between the housing 11 and the member 3 such that relative rotation between the housing and the member 3 is prevented but free movement of the filament 16 between the two can take place in a manner similar or identical to that described. Such positively acting means may include toothed elements e.g. gears. Such geared assemblies may include swashing gears, and gear trains and/or shafts in which the axes of rotation of such gears and shafts may be parallel or otherwise to the axis or of rotation of the plates 13 and 7 and some gears may or may not be identical. Other types of toothed assembly may include toothed belts and toothed pulleys.

The coils formed on the mandrel 1 by the coiling filament 16 are caused to be fed along the mandrel as they are formed. The mandrel itself is tapered so as to reduce the tendency of the coils to bind, a preferred mandrel head being shown in FIGS. 4*a* and 4*b*. The mandrel is thus provided with two ramps 40 at its base, up which the filament rides to push off a previous coil formed round two pins 41. The height of the ramps is greater than the diameter of the filament. Preferably, the two opposing sides of the ramp have a relative taper to facilitate pushing off of the coils. In order that the coils should remain in a shape conforming closely to the shape of the mandrel cross-section the material of the filament 16 should possess a suitable plastic yield point. Where all portions of the mandrel cross-section or cross-sections that affect the shape of the coil are rectilinear or convex no additional aids are likely to be required to make the filament 16 conform to the said cross-section or cross-sections unless the filament 16 is very stiff. However, where portions of the cross-section or cross-sections are concave or in such cases of high stiffness additional elements such as plungers may be required to press the filament 16 against the mandrel 1. These elements may act once or more during the formation of coil or with a less frequency, e.g. once every other coil, as may be required. Other shaping means such as rolls may also be used to shape the coils which shaping means may or may not operate in a manner independent of the mandrel. These or other shaping means may also be used where it is required that coils are not necessarily all the same shape.

Certain advantages may be gained from a mandrel of circular cross-section. However, unlike many cases with a non-circular cross-section, difficulty may be experienced in coiling the filament 16 on to the mandrel without the coils slipping on the one hand or binding on the other. In such a case, it may be necessary to have additional means such as plungers or pressure rollers which can grip the coils on the mandrel without impeding the feed of the coils along the mandrel. An advantage of the circular mandrel is that the filament 16 is coiled at a constant speed. For non-circular mandrels it will be usual for the filament to be taken on to the mandrel at a speed possessing a cyclic variation. The cyclic speed variation could cause problems resulting from varying tension of the filament 16 or overspeeding of the coiling filament spool, most of which problems increase with speed and the inertia of the coiling filament spool. With non-circular mandrels it is therefore particularly desirable to introduce tension or other controls but for known reasons it is prudent to have them for circular mandrels also. These are conveniently applied to the coiling filament spool and to the coiling filament between the said spool and guide pulley 28. It is also desirable for controls to be applied to the core filament 15 and its spool 2. Such controls and other controls for stopping the machine in cases of filaments breaking, spools running low of filament, overloading etc. may be of purely conventional design and so are not detailed here.

The invention is particularly applicable to machines which assemble the coils, a core filament and a bonding filament into heat exchangers or elements for use in heat exchangers. A preferred method of bonding the coils to a tube or rod includes the use of a core filament or filaments 15 as a carrier or carriers for a bonding material which may be coated thickly or otherwise on the filaments 15. This coating provides protection for the core filament, and a means of introducing the bonding material and bore filament as one into the coils. The presence of some bonding materials inside the coils can aid the process of bonding the coils to the tube or rod. Where a single core filament is used it may be found desirable, depending upon the shape of the coils in contact with the said tube or rod, to flatten the filament since a flattened filament can give greater stability to the coils being held on the tube or rod by the core filament and prior to bonding the said coils to the said tube or rod. Alternatively, a plurality of coated core filaments may be used and it may be desirable to bond these together into a composite assembly so that the whole is drawn on to the tube or rod as one. Where such a composite assembly is used it may with advantage take the form of a flat ribbon. The bonding of the coils to the tube or rod may be achieved by using a fusible bonding material and materials for filaments and tube or rod compatible with the bonding material so that when the bonding process has been completed a sufficiently strong bond is attained between the coils and the tube or rod. For some heat transfer purposes solder is a suitable bonding material and brass or copper are suitable materials for the filaments and tube or rod. Other materials may also be used. The bonding process, in the case of a fusible material such as solder, consists in fusing the material in contact with the elements to be bonded, these elements being in contact and allowing the material to solidify. Additional bonding material may be supplied as necessary. It may be desirable to include in the pretreatment of the tube or rod a partial or complete precoating with bonding material in addition to the usual cleaning, fluxing etc., the coiling filament may be similarly treated in part or in whole, before or after coiling. Other types of bonding process using other bonding materials can include adhesives with one or more chemical components or accelerators that are applied as required to filaments and tube or rod, heat being applied as necessary to speed or improve the bonding process and/or bond.

Means for starting the coils and filaments on the tube or rod are not detailed here nor are the basic methods of driving the tube or rod because they follow well-known principles. During most of the operating cycle the coiling head and tube or rod drive are geared together. However, at certain points in the machine operating cycle relating to the manufacture of a heat exchange means or element to be used in such, arrangements are made, using for example, electromagnetic clutches, whereby the drives can be disconnected and operated independently as necessary. At the start or finish of winding coils on to a tube or rod it may be necessary to wind on and bond a length of core filament only without coiling; similarly when gaps or spaces are to be produced between groups of coils. In finishing a group of coils the coiled filament has to be cut at some point between the start of coiling and the point of bonding the coils to the tube or rod, and the coiling head is stopped. The remaining length of coil attached to the coil on the tube or rod is wound on and bonded and then a further length of core filament alone is wound on and bonded. In the case of a space between groups of coils a further length of core filament is wound on, preferably not bonded, and at suitable points bonding of the core filament starts again and the coiling head is restarted. Bonding may be prevented by such means as inserting some non-bondable material, for example a non-combustible tape or a coating of emulsion between filament and tube or rod and/or stopping fusing of the bonding material. In the case of the last group of coils the bonding filament is cut without winding on a length of unbonded core filament. At some point any unbonded core filament is removed. In this way groups of coils can be started and finished and spaces formed between them. Groups and spaces can be of equal or variable size. The control over these various drive, bonding and cutting operations may be carried out manually or automatically, and actuated directly or indirectly by the tube or rod or coils thereon or by any part of the drive mechanism including the coiling head by the use of counting mechanisms or in any known manner.

Where tubes or rods are of non-circular cross-section such tube or rod driven at constant angular velocity will wind on the coils and core filament at a cyclically varying speed. If necessary such speed variations may be largely or wholly eliminated by known means inserted in the drive between coiling head and tube or rod or such speed variation can be allowed, means such as a sufficient reserve of coils before bonding of coils providing a reservior.

For some heat exchange processes better results may be obtained from heat exchange means or elements of the type manufactured by the present embodiment when one or more coils are displaced in some manner relative to one another and substantially axially or otherwise to the tube or rod. Means for achieving such relative displacement may be applied to the coils at any suitable time including after bonding of the coils to the tube or rod.

I claim:

1. A machine for coiling wire about a core filament comprising a main frame, two coiling elements spaced from each other and mounted in the frame for rotation about substantially the same axis, a hollow mandrel on which the wire is to be coiled, the longitudinal axis of the mandrel substantially coinciding with said axis, a wire guide on each of the coiling elements spaced from the said axis whereby a loop of wire may be formed with its ends substantially on the said axis and the remainder thereof spaced from the said axis, means for rotating the two coiling elements in a substantially synchronous fashion so that wire guided about the elements is coiled on to the mandrel, means for preventing the mandrel from rotating relative to the frame, and means for feeding a core filament through the hollow mandrel, wherein the mandrel carries a plurality of pins around which coils of wire are formed, the mandrel having a tapering portion up which a coil in the process of being formed rides and thereby pushes off from the pins a previously formed coil.

2. A machine as claimed in claim 1, wherein the means for preventing the mandrel from rotating comprises a latch which is movable to allow the loop of wire to pass the latch as the loop is rotated by the coiling elements.

3. A machine as claimed in claim 1, wherein the means for preventing the mandrel from rotating comprises means for causing a fluid dynamic force to act between the machine frame and a part secured to the mandrel to normally maintain the two stationary with respect to one another and which applies a restoring torque in the event that the said part is displaced with respect to the frame, the fluid dynamic means allowing the loop of wire to pass therethrough as the loop is rotated by the coiling elements.

4. A machine as claimed in claim 1, wherein the means for preventing the mandrel from rotating comprises a magnetic device.

5. A machine as claimed in claim 1, wherein a spool of wire is mounted between the coiling elements with its axis of rotation transverse to the axis of rotation of the coiling elements, the spool being connected to the mandrel and held non-rotatable therewith with respect to the frame about the axis of rotation of the coiling elements, the said feeding means being provided for guiding wire from the said spool through the mandrel whereby to locate it as the core wire within the coils of wire formed on the mandrel.

6. A machine as claimed in claim 5, comprising a bobbin support frame carrying the spool rotatably mounted therein, and a bobbin support frame carrier in which the bobbin support frame is non-rotatably mounted.

7. A machine as claimed in claim 6, wherein the bobbin support frame is resiliently mounted in the bobbin support frame carrier to allow movement of the bobbin support frame along the axis of rotation of the coiling elements.

8. A machine as claimed in claim 6 wherein an adjustable brake is provided for controlling rotation of the spool and hence the tension wire coming from the spool.

9. A machine as claimed in claim 6, wherein a resiliently mounted guide is provided for guiding wire from the spool into the mandrel.

10. A machine as claimed in claim 1, wherein the means for rotating the coiling elements comprises a layshaft and two transmissions each connecting the layshaft to a respect one of the elements.

11. A machine as claimed in claim 1, wherein the said tapering portion of the mandrel is defined by a plurality of ramps.

* * * * *